US008276891B2

(12) United States Patent
Uchida

(10) Patent No.: US 8,276,891 B2
(45) Date of Patent: Oct. 2, 2012

(54) GAS MIXTURE SUPPLYING METHOD AND APPARATUS

(75) Inventor: Yohei Uchida, Nirasaki (JP)

(73) Assignee: Tokyo Electron Limited, Tokyo (JP)

( * ) Notice: Subject to any disclaimer, the term of this patent is extended or adjusted under 35 U.S.C. 154(b) by 281 days.

(21) Appl. No.: 12/641,936

(22) Filed: Dec. 18, 2009

(65) Prior Publication Data

US 2010/0155971 A1 Jun. 24, 2010

Related U.S. Application Data

(60) Provisional application No. 61/159,831, filed on Mar. 13, 2009.

(30) Foreign Application Priority Data

Dec. 22, 2008 (JP) ..... 2008-325418

(51) Int. Cl.
*B01F 3/04* (2006.01)

(52) U.S. Cl. ... 261/128; 261/16; 261/23.1; 261/DIG. 65

(58) Field of Classification Search ..... 261/16, 261/23.1, 42, 53, 128, 130, 131, 133, 136, 261/137, DIG. 65; 204/298.33
See application file for complete search history.

(56) References Cited

U.S. PATENT DOCUMENTS 4,033,287 A * 7/1977 Alexander et al. ..... 118/723 E
4,066,481 A * 1/1978 Manasevit et al. ..... 117/90
4,579,623 A * 4/1986 Suzuki et al. ..... 438/7
5,049,317 A * 9/1991 Kiske et al. ..... 261/16
5,262,356 A * 11/1993 Fujii ..... 438/488
5,280,012 A * 1/1994 Kirlin et al. ..... 505/447
5,308,433 A * 5/1994 Otsuka et al. ..... 117/93
5,419,924 A * 5/1995 Nagashima et al. ..... 427/248.1
5,785,796 A * 7/1998 Lee ..... 156/345.24
6,352,244 B2 * 3/2002 Lin et al. ..... 261/127
6,464,782 B1 10/2002 Sivaramakrishnam et al.
7,754,656 B2 * 7/2010 Xiang et al. ..... 506/7
7,883,076 B2 * 2/2011 Okabe et al. ..... 261/142
2002/0152797 A1 * 10/2002 McAndrew et al. ..... 73/23.2

FOREIGN PATENT DOCUMENTS

CN 101125639 A 2/2008
JP 8-88191 4/1996

* cited by examiner

*Primary Examiner* — Charles Bushey
(74) *Attorney, Agent, or Firm* — Oblon, Spivak, McClelland, Maier & Neustadt, L.L.P.

(57) ABSTRACT

A gas mixture supplying method includes supplying plural kinds of gases through gas supply lines connected to a common pipeline and supplying a gas mixture of the plural kinds of gases from a gas outlet of the common pipeline into a region where the gas mixture is used through a gas mixture supply line. When a typical gas supplied in a gaseous state from a gas supply unit and a liquid source gas vaporized by heating a liquid source material supplied from a liquid source material supply unit by a vaporizing unit are supplied simultaneously, the liquid source gas is supplied from one of the gas supply lines provided at a position closer to the gas outlet than that for the typical gas, and the liquid source gas is supplied to a downstream side of a filter for removing particles in the typical gas.

14 Claims, 1 Drawing Sheet

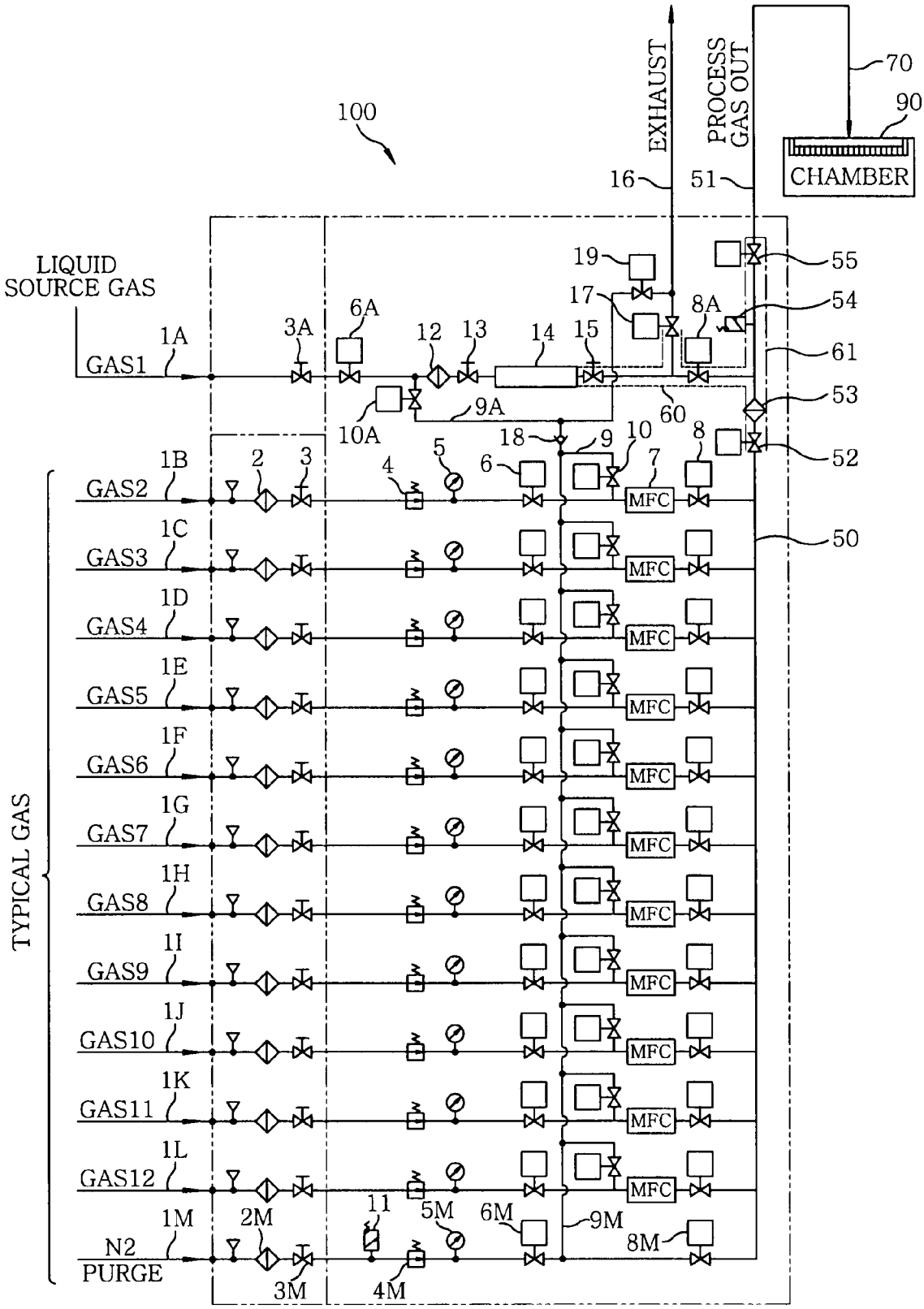
100
EXHAUST
PROCESS GAS OUT
CHAMBER
70
90
16
51
LIQUID SOURCE GAS
GAS1
1A
3A
6A
12
13
14
15
19
17
8A
55
54
61
53
52
50
60
9A
10A
18
9
10
8
7
6
5
4
2
3
MFC
TYPICAL GAS
GAS2
1B
GAS3
1C
GAS4
1D
GAS5
1E
GAS6
1F
GAS7
1G
GAS8
1H
GAS9
1I
GAS10
1J
GAS11
1K
GAS12
1L
N2 PURGE
1M
2M
3M
4M
5M
6M
9M
8M
11

GAS MIXTURE SUPPLYING METHOD AND APPARATUS

CROSS-REFERENCE TO RELATED APPLICATIONS

This application claims priority to Japanese Patent Application No. 2008-325418 filed on Dec. 22, 2008, the entire contents of which are incorporated herein by reference.

FIELD OF THE INVENTION

The present invention relates to a gas mixture supplying method and apparatus for use in, for example, a semiconductor manufacturing apparatus.

BACKGROUND OF THE INVENTION

Conventionally, a gas mixture supplying apparatus for mixing and supplying gases, so-called a gas box or the like, is generally employed when a gas mixture including different kinds of gases is supplied as a processing gas into a region where the gas mixture is used such as a processing chamber of a semiconductor manufacturing apparatus, e.g., when an etching gas is supplied into a processing chamber of a plasma etching apparatus.

The gas mixture supplying apparatus is configured to mix and supply plural gases through a plurality of gas supply lines connected to one common pipeline (manifold) and then to supply the mixture of the gases into the region where the mixture of gases is used through a gas mixture supply line via a gas outlet of the common pipeline.

A gas supplied by using the gas mixture supplying apparatus includes a gas in the gaseous state at a normal temperature and pressure, which is supplied from a gas supply unit in the gaseous state, (hereinafter, referred to as "typical gas"); and a gas vaporized by heating a liquid source material supplied from a liquid source material supply unit by a vaporizing unit (hereinafter, referred to as "liquid source gas"). To supply such liquid source gas, there is known a method of supplying a liquid source gas having a relatively low vapor pressure from a position closer to the processing chamber (see, e.g., Japanese Patent Application Publication No. 1996-88191 and its corresponding U.S. Pat. No. 6,464,782).

When the etching gas is supplied into the processing chamber of the plasma etching apparatus or the like by using the gas mixture supplying apparatus as described above, a filter is provided in the common pipeline (manifold) or the gas mixture supply line to remove particles present in the gas mixture after the typical gas and the liquid source gas are mixed. Since, however, this filter has low conductance, a pressure of the gas mixture may be increased in this filter, raising likelihood that the liquid source gas may be condensed. For this reason, the common pipeline (manifold), the gas mixture supply line and so forth are conventionally heated to a high temperature by a heater, thus preventing the condensation of the liquid source gas.

In the conventional technology as stated above, however, since the common pipeline (manifold), the gas mixture supply line and so forth need to be heated to the high temperature by the heater to prevent the condensation of the liquid source gas, there has been a problem that the power consumption is increased due to the heating by the heater may be increased.

SUMMARY OF THE INVENTION

In view of the foregoing, the present invention provides a gas mixture supplying method and apparatus capable of reducing power consumption required for a heating operation by a heater to save energy when a liquid source gas vaporized by heating a liquid source material is used.

In accordance with an aspect of the present invention, there is provided a gas mixture supplying method, including: supplying plural kinds of gases through gas supply lines connected to a common pipeline; and supplying a gas mixture of the plural kinds of gases from a gas outlet of the common pipeline into a region where the gas mixture is used through a gas mixture supply line, wherein, when a typical gas supplied in a gaseous state from a gas supply unit and a liquid source gas vaporized by heating a liquid source material supplied from a liquid source material supply unit by a vaporizing unit are supplied simultaneously, the liquid source gas is supplied from one of the gas supply lines provided at a position closer to the gas outlet than that for the typical gas, and the liquid source gas is supplied to a downstream side of a filter for removing particles in the typical gas.

In accordance with another aspect of the present invention, there is provided a gas mixture supplying apparatus for supplying a gas mixture, including: a common pipeline having a gas outlet; gas supply lines connected to the common pipeline, for supplying plural kinds of gases; and a gas mixture supply line for supplying a gas mixture of the plural kinds of gases from the gas outlet of the common pipeline to a region where the gas mixture is used, wherein, when a typical gas supplied in a gaseous state from a gas supply unit and a liquid source gas vaporized by heating a liquid source material supplied from a liquid source material supply unit by a vaporizing unit are supplied simultaneously, the liquid source gas is supplied from one of the gas supply lines provided at a position closer to the gas outlet than that for the typical gas, and the liquid source gas is supplied to a downstream side of a filter for removing particles in the typical gas.

In accordance with the present invention, there is provided a gas mixture supplying method and apparatus capable of reducing power consumption for a heating operation by a heater to save energy when a liquid source gas vaporized by heating a liquid source material is used.

BRIEF DESCRIPTION OF THE DRAWINGS

The objects and features of the present invention will become apparent from the following description of embodiments, given in conjunction with the accompanying drawing, which is a schematic view of a gas mixture supply apparatus in accordance with an embodiment of the present invention.

DETAILED DESCRIPTION OF EMBODIMENT

Hereinafter, embodiment of the present invention will be described in detail with reference to the accompanying drawing which forms a part hereof.

The drawing is a schematic view of a gas mixture supplying apparatus in accordance with an embodiment of the present invention. As illustrated in the drawing, the gas mixture supplying apparatus 100 includes a plurality of gas supply lines 1A to 1M (13 lines in the present embodiment) corresponding to plural kinds of gases, and one ends of these respective gas supply lines 1A to 1M are connected to one common pipeline (manifold) 50.

A gas outlet 51 at one end of the common pipeline (manifold) 50 is connected to a gas mixture supply line 70, and the gas mixture supply line 70 is connected to a processing chamber 90 of a semiconductor manufacturing apparatus (plasma etching apparatus in the present embodiment) which is a region where the gas mixture is used.

Among the gas supply lines 1A to 1M, the gas supply line 1A provided at a closest position to the gas outlet 51 is used to supply a liquid source gas (GAS1) vaporized by heating a liquid source material, which is supplied from a liquid source material supply unit (not shown), by a vaporizing unit.

Further, the other gas supply lines 1B to 1M are used to supply typical gases that are supplied from gas supply units (not shown) in the gaseous state. Among the gas supply lines 1B to 1M, the gas supply line 1M located at a farthest position from the gas outlet 51 is for supplying a nitrogen gas ($N_2$ gas) as a purge gas, while the other gas supply lines 1B to 1L are used to supply typical gases as processing gases (GAS2 to GAS12).

Each of the gas supply lines 1B to 1L is provided with a filter 2, a manual valve 3, a regulator 4, a pressure gauge 5, a first air operation valve 6, a mass flow controller 7 and a second air operation valve 8 in sequence from the upstream side thereof.

Further, each of the gas supply lines 1B to 1L is also provided with a branch line 9 branched from between the first air operation valve 6 and the mass flow controller 7. A third air operation valve 10 is installed on each branch line 9.

Further, the gas supply line 1M for supplying the nitrogen gas ($N_2$ gas) as the purge gas is provided with a filter 2M, a manual valve 3M, a pressure switch 11, a regulator 4M, a pressure gauge 5M, a first air operation valve 6M and a second air operation valve 8M in sequence from the upstream side thereof. Moreover, a branch line 9M is branched from between the first air operation valve 6M and the second air operation valve 8M, and the branch line 9M is connected with the branch lines 9 branched from the gas supply lines 1B to 1L as described above.

The gas supply line 1A for supplying the liquid source gas (GAS1) is provided with a first manual valve 3A, a first air operation valve 6A, a filter 12, a second manual valve 13, a flow rate controller 14 having a vaporizing unit, a third manual valve 15, and a second air operation valve 8A in sequence from the upstream side thereof. The filter 12 is provided to remove particles from the liquid source material, thus preventing the particles from being included in the liquid source gas.

Furthermore, the gas supply line 1A is also provided with a branch line 9A branched from between the first air operation valve 6A and the filter 12, and a third air operation valve 10A is provided on the branch line 9A. The branch line 9A is connected with the branch line 9M.

Moreover, the gas supply line 1A is also provided with a second branch line 16 branched from between the third manual valve 15 and the second air operation valve 8A of the gas supply line 1A. A fourth air operation valve 17 is provided on the branch line 16.

A check valve 18 is provided at a connection between the branch line 9A and the branch line 9M. Further the branch line 9A is connected to the second branch line 16, and a fifth air operation valve 19 is provided on the branch line 9A in the vicinity of its connection with the second branch line 16.

Further, an air operation valve 52 and a filter 53 are provided between a connection of the common pipeline (manifold) 50 with the gas supply line 1A and a connection of the pipeline 50 with the gas supply line 1B. The filter 53 serves to remove particles in a mixture of the typical gases flowing through the inside of the common pipeline (manifold) 50. Further, a pressure switch 54 and an air operation valve 55 are provided downstream of the connection of the common pipeline (manifold) 50 with the gas supply line 1A.

Further, as illustrated by a dotted line in the drawing, provided downstream of the flow rate controller 14 having the vaporizing unit of the gas supply line 1A for supplying the liquid source gas (GAS1) is a first heater 60 configured to heat this downstream region. In addition, as illustrated by a dashed dotted line in the drawing, a second heater 61 is provided downstream of the air operation valve of the common pipeline (manifold) 50 to heat this downstream region. The first heater 60 and the second heater 61 serve to heat the liquid source gas flowing through the inside of the gas supply line 1A and the common pipeline (manifold) 50, respectively, to prevent condensation of the liquid source gas.

As stated above, in the gas mixture supplying apparatus 100 in accordance with the present embodiment, the gas supply line 1A for supplying the liquid source gas (GAS1), which is generated by heating the liquid source material supplied from the liquid source material supply unit by the flow rate controller 14 having the vaporizing unit, is provided at the closest position to the gas outlet 51. Further, the gas supply line 1A for supplying the liquid source gas (GAS1) is provided with the filter 12 for removing the particles in the liquid source material. Meanwhile, a filter for removing particles in the gas is provided at neither of the gas supply line 1A and the common pipeline (manifold) 50 downstream of the flow rate controller 14 having the vaporizing unit.

With such configuration, a pressure increase of the liquid source gas and the gas mixture including the liquid source gas due to a low-conductance filter and the resultant condensation of the liquid source gas can be suppressed. Accordingly, even though heating amounts by the first heater 60 and the second heater 61 are reduced as compared to the conventional case, condensation of the liquid source gas can be still prevented. In this way, since the power consumption required for the heating operation of the first heater 60 and the second heater 61 can be reduced as compared to the conventional case, energy saving can be accomplished.

A heating temperature of the second heater 61 (second temperature) is set to be lower than a heating temperature of the first heater 60 (first temperature).

Specifically, the heating temperature (first temperature) of the first heater 60 is set to be at a level where a vapor pressure of the liquid source material becomes equal to or higher than an internal pressure of the gas supply line 1A for supplying the liquid source gas. Further, in this case, since the internal pressure of the gas supply line 1A varies depending on a flow rate of the liquid source gas, the heating temperature of the first heater 60 may be varied depending on the internal pressure of the gas supply line 1A, or the heating temperature of the first heater 60 may be set to a level such that the above-stated conditions can still be satisfied even when the liquid source gas flows at a maximum flow rate available in this gas mixture supply apparatus 100.

Meanwhile, the heating temperature (second temperature) of the second heater 61 is set to be at a level where the vapor pressure of the liquid source material becomes equal to or higher than a partial pressure of the liquid source gas within the common pipeline (manifold) 50. Accordingly, the heating temperature (second temperature) of the second heater 61 becomes lower than the heating temperature (first temperature) of the first heater 60. By controlling the temperature of the gas supply line 1A and the common pipeline (manifold) 50 in this way, condensation of the liquid source gas within these lines can be prevented. Furthermore, since the condensation of the liquid source gas can be prevented with minimum power consumption, energy can be saved as compared to the conventional case.

Further, as an example of the liquid source gas, for example, $C_5F_8$, $C_6F_6$, $SiCl_4$, HF, or the like can be used.

Moreover, only one kind of these liquid source gases may be employed, or plural kinds of them may be employed at the same time.

Furthermore, it is to be noted that the present invention is not limited to the above-discussed embodiments and examples, but various changes and modifications may be made. For example, the processing chamber 90 is not limited to that of the plasma etching apparatus, but may be a processing chamber of a film forming apparatus such as a CVD (Chemical Vapor Deposition) apparatus or the like. Furthermore, the number of the gas supply lines may be more than or less than 13 without being limited to 13.

While the invention has been shown and described with respect to the embodiment, it will be understood by those skilled in the art that various changes and modification may be made without departing from the scope of the invention as defined in the following claims.

What is claimed is:

1. A gas mixture supplying method, comprising:

providing one or more typical gases in a gaseous state from respective gas supply units through plural gas supply lines to a common pipeline to form a first gas mixture;

providing a first filter within the common pipeline to remove particles from the first gas mixture, the first filter provided at a point in the common pipeline that is downstream of the plural gas supply lines;

supplying a liquid source material from a liquid source supply unit to a vaporizing unit;

heating the liquid source material within the vaporizing unit to form a liquid source gas;

supplying the vaporized liquid source gas to the common pipeline at a point downstream of the first filter in the common pipeline;

mixing the vaporized liquid source gas with the first gas mixture to form a second gas mixture; and supplying the second gas mixture from a gas outlet of the common pipeline into a region of use of the second gas mixture.

2. The gas mixture supplying method of claim 1, wherein a second filter is provided in a gas supply line for supplying the liquid source material to remove particles in the liquid source material, thereby preventing the particles from being included in the liquid source gas.

3. The gas mixture supplying method of claim 1, wherein a region of a gas supply line for supplying the liquid source gas between the vaporizing unit and a connection with the common pipeline is heated to a first temperature by a first heater, and at least a region of the common pipeline between the connection with the gas supply line for supplying the liquid source gas and the gas outlet is heated by a second heater to a second temperature lower than the first temperature.

4. The gas mixture supplying method of claim 3, wherein the first temperature is set to be at a level where a vapor pressure of the liquid source material becomes equal to or higher than an internal pressure of the gas supply line for supplying the liquid source gas.

5. The gas mixture supplying method of claim 3, wherein the second temperature is set to be at a level where the vapor pressure of the liquid source material becomes equal to or higher than a partial pressure of the liquid source gas within the common pipeline.

6. The gas mixture supplying method of claim 1, wherein the region where the second gas mixture is used is a processing chamber of a plasma etching apparatus.

7. The gas mixture supplying method of claim 1, wherein the liquid source gas is at least one of $C_5F_8$, $C_6F_6$, $SiCl_4$, and HF.

8. A gas mixture supplying apparatus for supplying a gas mixture, comprising:

a common pipeline having a gas outlet;

gas supply lines connected to the common pipeline, for supplying plural kinds of gases, the gas supply lines including a first gas supply line and a second gas supply line;

a gas supply unit for supplying a typical gas in a gaseous state via the first gas supply line into the common pipeline;

a vaporizing unit for vaporizing a liquid source gas by heating a liquid source material supplied from a liquid source material supply unit, said vaporizing unit connected to the second gas supply line for supply of the liquid source gas into the common pipeline;

a gas mixture supply line for supplying a gas mixture of the typical gas and the liquid source gas from the gas outlet of the common pipeline to a region where the gas mixture is used;

a first filter in the common pipeline for removing particles from the typical gas, said filter disposed downstream from the first gas supply line and upstream of the second gas supply line.

9. The gas mixture supplying apparatus of claim 8, wherein a second filter is provided in the second gas supply line for supplying the liquid source material to remove particles in the liquid source material, thereby preventing the particles from being included in the liquid source gas.

10. The gas mixture supplying apparatus of claim 8, wherein a region of the second gas supply line for supplying the liquid source gas between the vaporizing unit and a connection with the common pipeline is heated to a first temperature by a first heater, and at least a region of the common pipeline between the connection with the second gas supply line for supplying the liquid source gas and the gas outlet is heated by a second heater to a second temperature lower than the first temperature.

11. The gas mixture supplying apparatus of claim 10, wherein the first temperature is set to be at a level where a vapor pressure of the liquid source material becomes equal to or higher than an internal pressure of the second gas supply line for supplying the liquid source gas.

12. The gas mixture supplying apparatus of claim 10, wherein the second temperature is set to be at a level where the vapor pressure of the liquid source material becomes equal to or higher than a partial pressure of the liquid source gas within the common pipeline.

13. The gas mixture supplying apparatus of claim 8, wherein the region where the gas mixture is used is a processing chamber of a plasma etching apparatus.

14. The gas mixture supplying apparatus of claim 8, wherein the vaporizing unit comprises a container of at least one of $C_5F_8$, $C_6P_6$, $SiCl_4$, and HF.

* * * * *